United States Patent [19]

Lindström

[11] 4,247,993

[45] Feb. 3, 1981

[54] NOZZLE APPARATUS FOR AIRBORNE PAPER WEB DRYERS

[75] Inventor: Yngve Lindström, Turku, Finland

[73] Assignee: Valmet Oy, Finland

[21] Appl. No.: 933,525

[22] Filed: Aug. 14, 1978

[30] Foreign Application Priority Data

May 4, 1978 [FI] Finland ..... 781375

[51] Int. Cl.[3] ..... F26B 13/20

[52] U.S. Cl. ..... 34/156; 34/160; 226/97; 239/DIG. 7

[58] Field of Search ..... 34/155, 160, 156; 406/88; 414/676; 226/7, 97; 239/DIG. 7

[56] References Cited

U.S. PATENT DOCUMENTS

| | | | |
|---|---|---|---|
| 3,587,177 | 6/1971 | Overly et al. | 34/156 |
| 3,650,043 | 3/1972 | Overly et al. | 226/97 |
| 3,873,013 | 3/1975 | Stibbe | 34/156 |
| 3,982,327 | 9/1976 | Kurie et al. | 34/156 |

FOREIGN PATENT DOCUMENTS 1302091 1/1973 Fed. Rep. of Germany .

*Primary Examiner*—Larry I. Schwartz
*Attorney, Agent, or Firm*—Steinberg & Raskin

[57] ABSTRACT

Nozzle apparatus for airborne paper web dryers of the non-impingement or underpressure type including a blow box member defined by top web supporting and bottom wall portions and back and front wall portions. The front and top supporting wall portions are interconnected by a curved guide surface and an upwardly directed nozzle is provided on the front wall portion spaced below the entry edge plane of the guide surface. The relative values of the width of the nozzle gap and the radius of curvature of the curved guide surface are such that the gas flow exiting from the nozzle follows a portion of the guide surface and departs therefrom prior to the exit edge plane of the guide surface. The upper surface of the top supporting wall of the blow box defines a small angle with the running plane of the web.

6 Claims, 3 Drawing Figures

NOZZLE APPARATUS FOR AIRBORNE PAPER WEB DRYERS

BACKGROUND OF THE INVENTION

This invention relates generally to airborne paper web dryers and, more particularly, to airborne paper web dryers of the non-impingement or underpressure type over which a web travels in a running plane supported by a gas flow.

The provision of blow boxes in paper manufacturing and refining machines for supporting a travelling paper web in a manner such that the web does not physically contact any of the elements of the machine, that is, where the web is supported by appropriately directed gas flow, for purposes of web cleaning, drying and stabilizing are known. In such apparatus, the blown gas is directed through various types of nozzle equipment onto one or both sides of the web, after which the gas is drawn into subsequent nozzle apparatus for reuse. Of course, such gas has been previously heated to effectuate drying of the web.

Thus, conventional blow box apparatus used in airborne web drying comprise a set of nozzles which direct a gas flow on the travelling web for supporting and drying the same. Such conventional apparatus can be divided into two groups, namely, over-pressure or impingement type nozzles and underpressure or vacuum type nozzles. Blow box apparatus of the overpressure type employ the so called air-cushion principle in which air jets are directed to impinge against the web to provide a static overpressure in the space between the blow box and the web. Blow boxes employing under-pressure include nozzles which direct gas flow in a direction substantially parallel to the web resulting in a air foil effect that attracts the web and stabilizes its run. The attracting force applied on the web in such cases is based on the well known principle whereby a gas flow field creates a static vacuum between the web and the supporting surface of the blow box. In both overpressure and underpressure nozzles, the so called Coanda phenomenon is often used in order to direct the air flow in a desired direction.

The use of conventional overpressure or impingement type nozzles has not been entirely satisfactory. More particularly, such overpressure blow boxes have nozzles which direct sharp air jets against the web. Although the air jet provides effective heat transfer in the localized area where the air jet impinges against the web, this fact results in an uneven heat transfer longitudinally along the web which may have a detrimental influence on the resulting quality of the web. Additionally, it is difficult to treat a web on one side only when using blow boxes of the overpressure type since the web tends to separate from the blow box apparatus due to the impingement of the air jets thereon.

Reference is made to U.S. Pat. Nos. 3,587,177 and 3,711,960 and Finnish patent No. 42522 and DE Announcement Publication No. 2,020,430, which relate to the present subject matter.

In particular, U.S. Pat. No. 3,587,177 discloses an underpressure nozzle wherein the nozzle slot opens on the entry side of the supporting surface of the blow box and extends to the curved flow guide surface attached to the front end of the supporting surface of the blow box so as to direct the flow to follow the curved guide surface due to the above mentioned Coanda phenomenon. Upon reaching the exit side of the curved guide surface, the gas flow is parallel with the web. A drawback of the blow box structure illustrated in this patent which is typical of conventional blow boxes of the underpressure type is that since the gas flow is directed along the supporting surface of the blow box, the thermal transfer coefficient between the gas flow and the web is relatively low. Furthermore, since the gas flow which was initially heated has tended to cool by virtue of its action in preceeding blow boxes, the temperature differential between the web and the drying gas is reduced resulting in a consequent reduction in the thermal transfer capacity which, as known, is proportional to the product of the temperature difference and the thermal transfer coefficient. Yet another problem with conventional underpressure type blow boxes is that the distance between the web and the supporting surface of the blow box is relatively small, approximating 2 to 3mm, which fact results in the danger of the web touching the support surface of the blow box with consequent web rupture and/or fouling of the nozzle surfaces.

SUMMARY OF THE INVENTION

Generally speaking, it is an object of the present invention to provide a new and improved blow box apparatus for airborne paper web dryers which avoids the drawbacks described hereinabove.

In accordance with this and other objects, the present invention is based upon certain principles which are described, for instance, in an article by D. W. Glaughlin and I. Grever, "Experiments On The Separation Of A Fluid Jet From A Curved Surface", in Advances In Fluids, 1978, pages 14–29. Such principles relate to the mechanism by which the path of a fluid jet departs from a curved wall and the various parameters influencing such departure. Insofar as the present invention is concerned, such principles are illustrated in the diagram in the above-identified article found on page 21, FIG. 5 thereof, which illustrates a set of curves on a coordinate system wherein the abscissa comprises a range of Reynolds numbers while the ordinate denotes the departure angle of the fluid jet. Each curve on the diagram denotes a ratio of the width of a nozzle gap, W, to the radius of the curved surface, R. The article illustrates that with the parameters presently existing in nozzle structures, a fluid jet will normally follow a curved surface through an angle of between 45 and 70 degrees.

Thus, in accordance with the present invention, a blow box apparatus is provided wherein the nozzle gap is located on the upwardly facing front wall of the blow box prior to the entry plane of the curved guide surface (in the direction of gas flow) and that the relation of the width of the nozzle gap to the radius of curvature of the curved guide surface is selected so that the gas flow departs from the curved guide surface substantially before the plane of the exit surface of the guide surface.

More particularly, in accordance with the present invention, the nozzle gap is provided in the direction of gas flow prior to the curved guide surface so that the direction of gas flow follows the curved guide surface over an angle of about 45 to 70 degrees. The curved guide surface is formed having an angle greater than 70 degrees so that the gas flow departs from the curved guide surface substantially before the plane of the exit edge thereof. Since the initial extent of the curved guide surface is formed substantially perpendicularly to the path of web travel, the velocity vector of the gas flow has at the point of departure from the blow box surface, a substantial component perpendicular to the web which results in the provision of turbulence in the boundary layer between the web and the gas flow. This is important from the view point of the present invention in that with increased turbulance, the thermal transfer coefficient between the gas flow and the web is considerably improved.

It is also a known principle that the degree of gas turbulence increases as the distance of the gas flow from the nozzle gap increases. Therefore, according to the present invention, a nozzle is provided which is located at a further spaced location from the web. Such provision results in an increased degree of turbulence of the gas flow on the web surface which thereby results in a higher thermal transfer coefficient being obtained.

A further advantage resulting from providing a gas flow having a velocity component perpendicular to the web is that warmer air is provided from previous blow boxes and, therefore, the temperature difference between the web and the gas flow is increased. Thus, it is seen that an arrangement according to the present invention favorably influences both of the parameters which determine the capacity of heat transfer, namely the thermal transfer coefficient and the temperature difference between the web and the gas flow.

An additional feature of the present invention results from the realization that the positive influence of the gas flows departure from the surface of the blow box can be enhanced by accelerating the gas flow in the space formed between the blow box supporting surface and the web. Thus, according to the present invention, such acceleration is provided by suitably reducing the cross section of the gas flow in the direction of flow by deviating the angle of the supporting surface of the blow box from the running direction of the web by a small angle. It has been determined empirically that an advantageous angle of deviation is between 0.5 to 10 degrees.

By virtue of the present invention, the additional advantage is obtained in that the distance between the web and the blow box support surface can be increased to a point where it is substantially as large as one-half the distance that can be obtained when using a double blow arrangement between the supporting surfaces. Thus, the stability of the web is improved while the danger of the web touching the supporting surface of the blow box is reduced.

According to the present invention, the nozzle gap is located on the front wall portion of the blow box and located prior to the curved guide surface (in the direction of gas flow) rather then being located on the guide surface itself. By virtue of this construction, the nozzle is defined by a pair of planar surfaces thereby resulting in a nozzle gap having a uniform width in the transverse direction. Such construction is advantageous in that the usual flow irregularities caused by an unevenly formed nozzle gap area with the consequent variations in the thermal transfer capacity are reduced to an insignificant level.

DESCRIPTION OF THE DRAWINGS

A more complete appreciation of the invention and many of the attendant advantages thereof will be readily appreciated as the same becomes better understood by reference to the following detailed description when considered in connection with the accompanying drawings in which.

DETAILED DESCRIPTION OF THE PREFERRED EMBODIMENT

Figure 3:
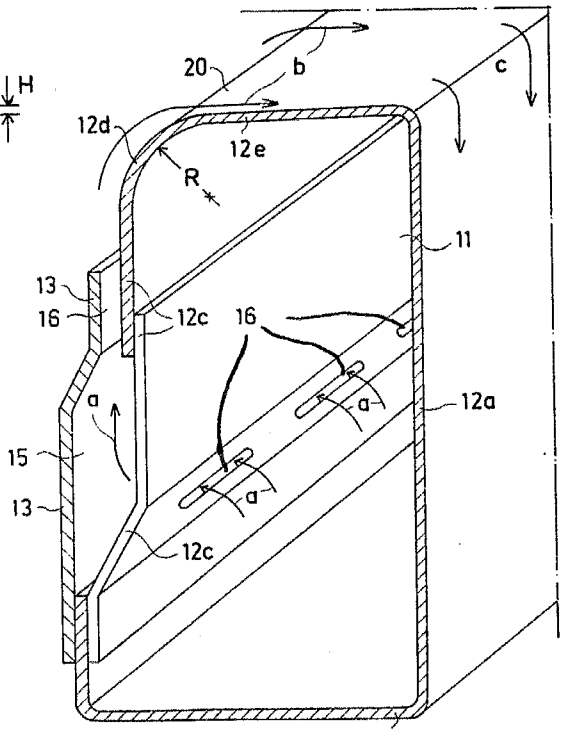
FIG. 3 is a perspective view in section of a blow box in accordance with the present invention.
Figure 1:
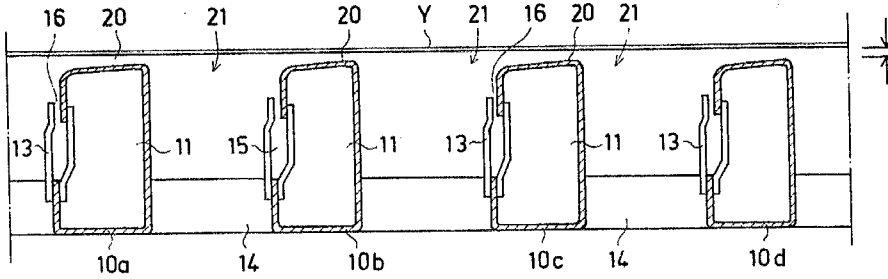
FIG. 1 is a diagramatic cross sectional side view of a hover or airborne dryer for a paper web comprising several blow boxes.

Referring now to the drawings wherein like reference characters designate identical or corresponding parts throughout the several views and more particularly to FIGS. 1 and 3 thereof, the hover or airborne web dryer of the present invention comprises a plurality of blow boxes 10*a*–10*d*, etc. Each blow box 10 comprises a back wall portion 12*a*, a front wall portion 12*c*, a bottom wall portion 12*b* and a cover or top wall portion 12*e*. The cover or top wall portion 12*e* has an upper surface, referred to hereinbelow as supporting surface 20.

The front wall portion 12*c* and cover or top wall portion 12*e* are interconnected by a curved guide section 12*d*. These wall portions together with the curved guide section 12*d* define an interior space 11 within blow box 10. It is seen that in the preferred embodiment illustrated in the figures, the back, bottom and top wall portions 12*a, b, e* and curved guide section 12*d* are integrally formed with front wall portion 12*c* comprising a pair of vertical sections horizontally displaced from each other and integrally formed with the above-identified portions. Further, front wall portion 12*c* includes a plate member extending across the space between the front wall portion sections having an inwardly directed portion. For convenience, the integral portions as well as the plate are referred to as front wall portion 12*c* and it is understood that such structure may be provided as a unitary member.

A front plate 13 is affixed to front wall portion 12*c* at its lower edge and extends upwardly thereon converging towards front wall portion 12*c* thereby defining a nozzle space 15 which converges into a nozzle gap 16.

A duct 14 extends across the line of blow boxes which fluidly intercommunicates with the interiors 11 thereof. A flow of drying gas is directed into the interiors 11 from duct 14, the gas flow entering nozzle space 15 through flow openings, the gas flow being designated "a" as seen in FIG. 3. The gas flow a is discharged through nozzle gap 16 and flows upwardly over a planar portion of the front wall portion 12*c*, then over a segment of the curved guide section 12*d* into the space defined between web Y and supporting surface 20, the gas flow being designated "b". The gas flow continues over supporting surface 20 and turns in a downward direction along back wall portion 12*a* within the spaces 21 between adjacent blow boxes 10, the gas flow being designated "c" in FIG. 3. From this point, the gas flow is directed to an outlet channel (not shown). The gas flow fields described above tend to stabilize the position of web Y at a certain distance H from supporting surface 20.

It should be noted that although in the preferred embodiment as shown in FIG. 1, the blow boxes are located only on one side of web Y, it is within the scope of the present invention to provide a blow box structure on both sides of the web in a manner which will be readily understood by those skilled in the art.

Figure 2:
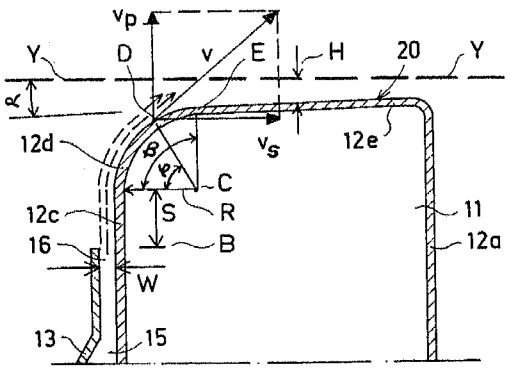
FIG. 2 is a cross sectional side view of the upper portion of a blow box apparatus in accordance with the present invention illustrating the various geometrical parameters which are important from the view point of the present invention.

Referring to FIG. 2, the width of the nozzle gap 16 is designated W. The nozzle gap 16 opens in a horizontal plane B from which the front wall portion 12c of the blow box continues in a vertical, planar configuration until the entry edge of curved guide section 12d, designated by the horizontal entry edge plane C, is reached. At this point, the curved guide section 12d extends and continues to a point designated E which designates the end edge of curved guide section 12d or, in other words, the entry edge of the planar cover or top wall portion 12e of the blow box 10. The distance over which the gas exiting from nozzle gap 16 flows between the plane B and the guide section entry edge plane C is designated S while the angle through which the gas flow follows the curved guide section 12d is designated by the sector "$\phi$". The path of the gas flow is designated by the dashed arrows in FIG. 2.

The gas flow discharged from nozzle gap 16 follows the curved guide surface 12d over the sector $\phi$ due to the above mentioned Coanda phenomenon which sector, as described above, varies between 45 and 70 degrees. Thus, at a plane designated D which constitutes a plane formed perpendicular to the curved guide section surface at the point at which the gas flow departs therefrom, the velocity vector v of the gas flow has a substantial velocity component $v_p$ which is perpendicular to the web Y. It is readily apparent that if angle $\phi$ is larger then 45°, the velocity component parallel to the running direction of web Y, $v_s$ will be larger then the velocity component $v_p$ perpendicular to the web.

The supporting surface 20 of top wall portion 12e forms a small angle $\alpha$ with the plane of the running direction of web Y, as shown in FIG. 2. In accordance with the invention, angle $\alpha$ may vary between about 0.5 and 10 degrees and it is preferred that angle $\alpha$ be approximately 2°. By providing this upwardly directed configuration of supporting surface 20, the angular extent, designated $\beta$, of the curved guide surface 12d will be something less than 90° where the front wall portion 12c is perpendicular to the running plane of web Y. This, however, is not particularly necessary from the point of view of the present invention. Thus, referring to the symbols shown in FIG. 2, a relationship exists wherein $\alpha$ plus $\beta$ equals 90° when the front wall portion 12c extends perpendicularly to the running plane of web Y.

The extent of the distance S formed between the plane of the nozzle gap exit B and the entry edge C of curved guide section 12d may vary. For example, it has been found that the present invention operates in an advantageous manner when the relationship 2.S equals R is followed. However, in some cases, a smaller value for S can also be advantageously employed.

Therefore, it is seen that the present invention results in a gas flow which departs from the curved guide section before reaching the exit edge E thereof. Preferably, best results are obtained where the gas flow departs after travelling along the curved guide section 12d for an extent in the range between about 45 to 70 degrees. By such provision, the departure of the gas flow creates turbulence in the gas flow between the web and the supporting surface 20 thereby increasing the thermal transfer coefficient therebetween. By providing for the spacing S between the nozzle gap and the entry edge plane of curved guide section 12d, the distance H is substantially enlarged relative to conventional designs. For example, H may be equal to approximately 4 to 6 mm. By providing a velocity component in the gas flow which is perpendicular to the path of travel of the web, warmer air is ejected from the space between the web and supporting surface than in previous blow boxes and, consequently, the temperature difference between the web and the gas flow is higher, thereby resulting in greater heat transfer. Finally, by providing a reduced area for the gas flow between the web and the supporting surface, the advantages of the departure of the gas flow from the curved guide surface are enhanced in that the drying action is accordingly increased.

Obviously, numerous modification and variations are possible in the light of the above teachings. It is therefore to be understood that within the scope of the appended claims the invention may be practiced otherwise then as specifically described herein.

What is claimed is:

1. Apparatus for airborne paper web dryers of the non-impingement or underpressure type over which a web is supported in a running plane comprising:

a blow box member defined by top web supporting and bottom wall portions, and back and front wall portions interconnecting said top and bottom wall portions, said blow box having an interior defined by said wall portions, said front wall portion having at least an upper portion which has a substantially planar configuration;

means provided on said front wall portion for defining an upwardly directed nozzle gap having a width and an exit plane, said nozzle gap being in fluid communication with the blow box interior whereby gas flow is directed through said nozzle gap from said blow box interior along said substantially planar upper portion of said front wall portion;

said front and top wall portions being interconnected by a curved guide surface having a radius of curvature, said curved guide surface and front wall portion meeting at a guide surface entry edge plane and said guide surface and top wall portion meeting at a guide surface exit edge plane, said nozzle gap exit plane being spaced a predetermined distance below said guide surface entry edge plane and located at a point from which said substantially planar upper portion of said front wall portion extends;

and the relative values of the width of the nozzle gap and the curved guide surface radius of curvature are such that said gas flow follows the planar portion of said front wall and a portion of said curved guide surface and departs from the latter prior to said exit edge plane thereof.

2. Apparatus as recited in claim 1 wherein said nozzle gap defining means includes a flow guide plate substantially parallely extending with and integrally connected to said front wall portion, said nozzle gap being defined by a space between said front wall portion and said flow guide plate.

3. Apparatus as recited in claim 1 wherein the running plane of the web and substantially the entire upper surface of the top supporting wall portion define a small angle therebetween in the range of about 0.5 to 10 degrees.

4. Apparatus as recited in claim 3 wherein said angle is about 2 degrees.

5. Apparatus as recited in claim 1 wherein said predetermined distance between said nozzle gap exit plane and the guide surface entry edge plane is about one half the radius of curvature of the curved guide surface.

6. Apparatus as recited in claim 1 wherein said curved guide surface extends over a central angle substantially greater than 70° and wherein the relative values of the width of the nozzle gap and the curved guide surface radius of curvature are such that gas flow follows a portion of said curved guide surface extending over a central angle in the range of about 45 to 70 degrees and then departs therefrom.

* * * * *